United States Patent [19]

Bingham et al.

[11] 3,981,370

[45] Sept. 21, 1976

[54] DISC CUTTING UNIT FOR USE ON ROCK BORING MACHINES

[75] Inventors: Henry Bingham; John Gilmour Glassford, both of Springs, Transvaal; Noel Cuthbert Pope, Johannesburg, Transvaal, all of South Africa

[73] Assignee: Hard Metals Limited, Johannesburg, South Africa

[22] Filed: May 31, 1973

[21] Appl. No.: 365,682

[30] Foreign Application Priority Data

June 2, 1972 South Africa ..... 72/3776

[52] U.S. Cl. ..... 175/373; 175/361; 175/374

[51] Int. Cl.[2] ..... E21B 9/14; E21B 9/36

[58] Field of Search ..... 175/371–374, 175/361, 364, 350, 351, 352, 227, 367, 368, 382

[56] References Cited

UNITED STATES PATENTS

| | | | |
|---|---|---|---|
| 1,143,275 | 6/1915 | Hughes | 175/367 |
| 1,673,285 | 6/1928 | Holdaway et al. | 175/350 |
| 1,705,055 | 3/1929 | Allison | 175/351 X |
| 3,204,710 | 9/1965 | Bechem | 175/351 X |
| 3,572,452 | 3/1971 | Winberg | 175/371 |
| 3,734,213 | 5/1973 | Goodfellow | 175/374 |
| 3,752,243 | 8/1973 | Hummer et al. | 175/372 X |

*Primary Examiner*—Ernest R. Purser
*Assistant Examiner*—Richard E. Favreau
*Attorney, Agent, or Firm*—Young & Thompson

[57] ABSTRACT

A rock-boring machine of the type comprising a rotatable headplate having a plurality of disc cutting units mounted on the front face of the headplate. Each disc cutting unit includes an annular rotatable body having a continuous recess extending around its periphery and a plurality of cutting segments located in the recess. The segments are secured in the recess by means of removable clamping means.

6 Claims, 2 Drawing Figures

DISC CUTTING UNIT FOR USE ON ROCK BORING MACHINES

This invention relates broadly to rock boring machines of the type in which a plurality of disc cutting units are mounted on the front face of a rotatable headplate. Such machines are primarily used for cutting through rock formations.

Conventionally each disc cutting unit comprises a base which is adapted to be secured to the headplate, a bearing shaft mounted in saddles or the like formed in the base and a cutting disc journalled for rotation on the shaft.

The cutting edge of the disc is generally a hardened steel member and when tungsten carbide is used this is in the form of separate segments not forming a continuous cutting edge.

It is accepted that, for optimum cutting efficiency, the cutting segments should be closely spaced to one another as possible. In other words, the outer edges of the cutting segments should, as closely as possible, approach a continuous surface. In the conventional disc cutting unit this is difficult to achieve as the cutting segments are generally located in individual recesses formed in the rotatable annular body.

It is an object of the present invention to provide a new and improved disc cutting unit in which the outer edges of the individual cutting segments provide a substantially continuous cutting surface.

According to the invention a disc cutting unit of the type described comprises a base adapted to be secured to the front face of a rotatable headplate of a rock boring machine, a bearing shaft mounted on the base, an annular body journalled for rotation on the bearing shaft, a continuous recess extending around the periphery of the body, a plurality of cutting segments located in the recess to extend around the periphery of the body, and removable clamping means adapted to secure the segments in the recess.

Figure 1:
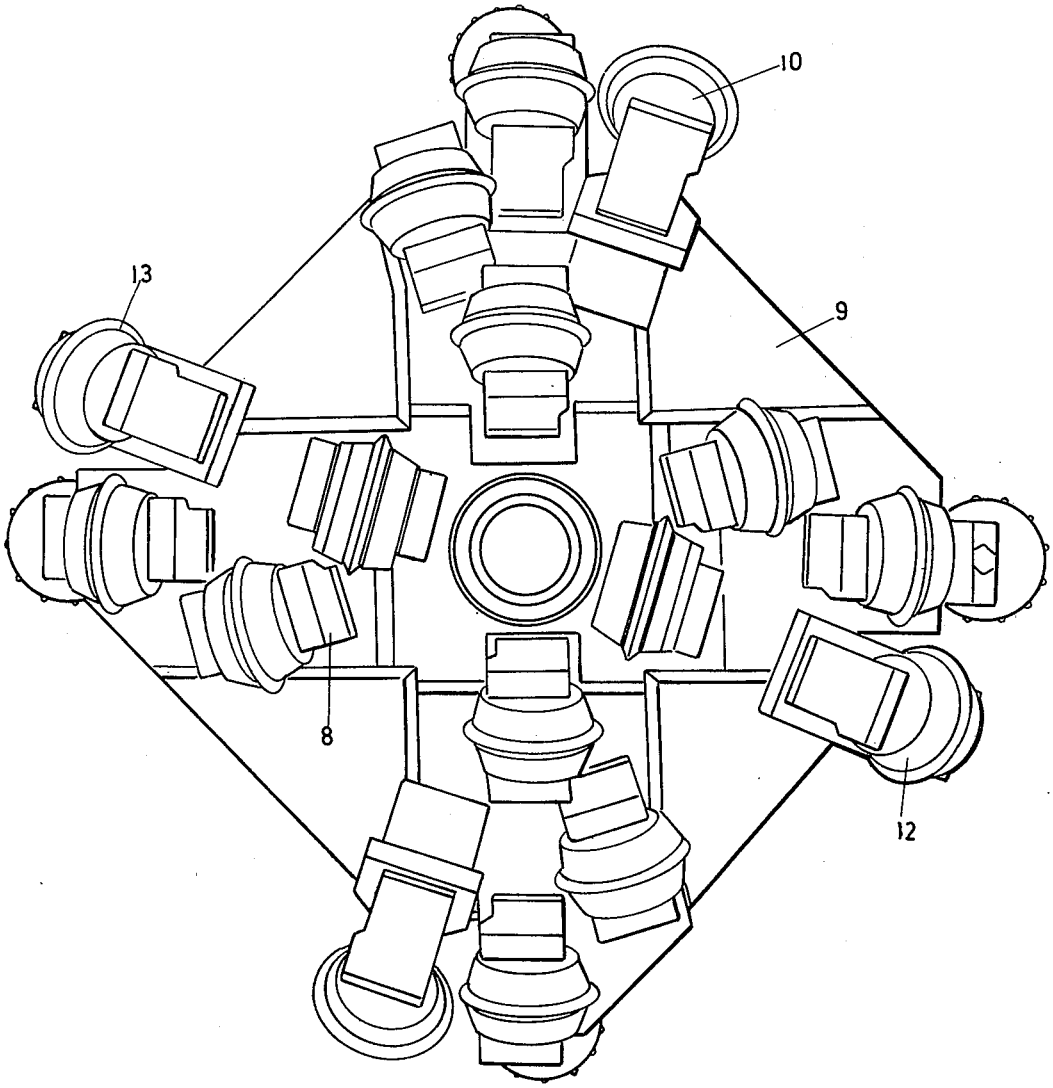
Figure 2:
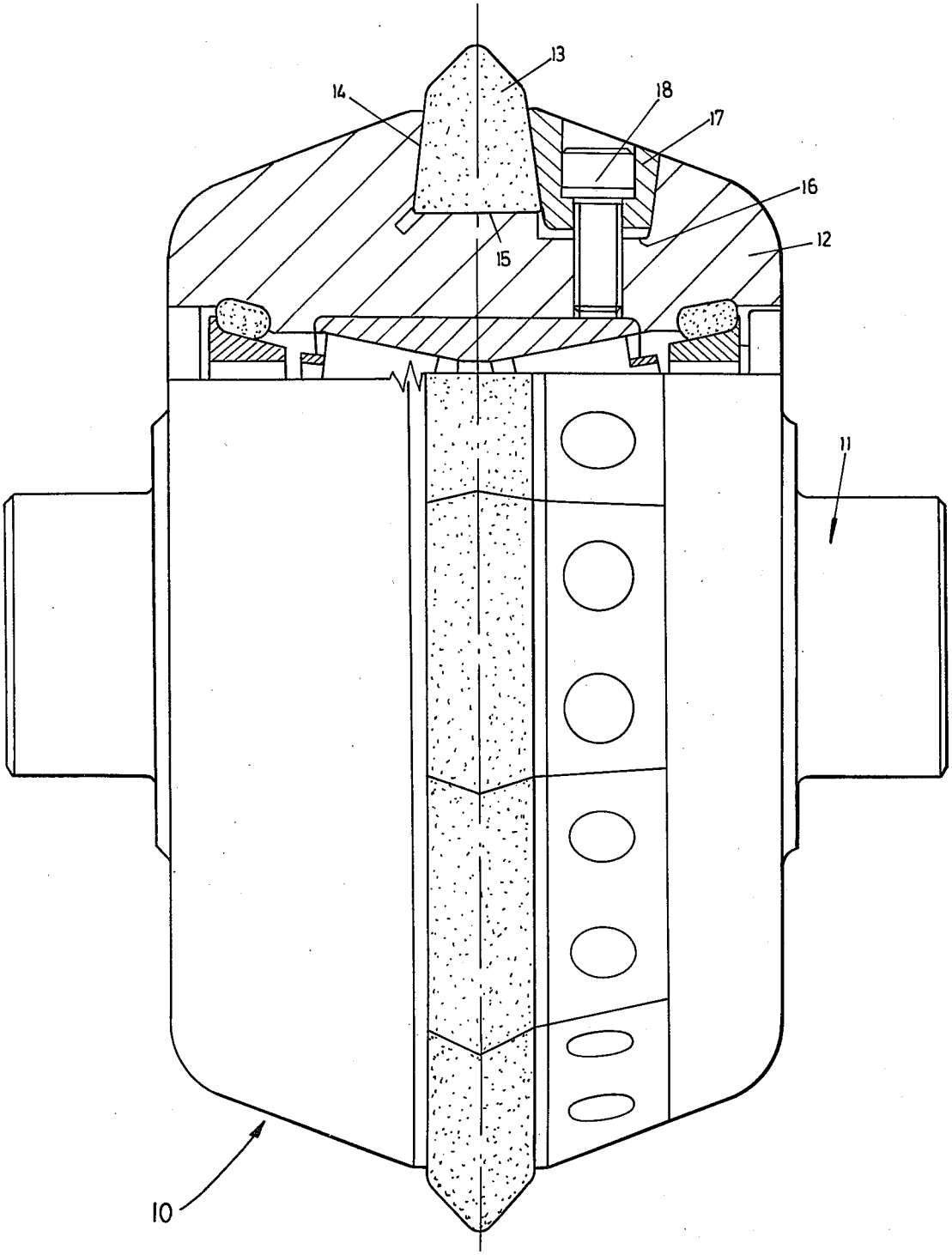

To illustrate the invention an embodiment thereof will now be described with reference to the accompanying drawings, in which FIG. 1 is an axial view of a rotatable headplate of a rock boring machine comprising the environment of the present invention and FIG. 2 is an enlarged elevational view partly in cross section of the disc cutting unit of the invention.

In the drawings the disc cutting unit 10 comprises a bearing shaft 11, which is adapted to be secured to a base or saddle 8 on the front face of a headplate 9 of a rock boring machine, an annular body 12 journalled for rotation on the bearing shaft, and a plurality of cutting segments 13 arranged around the periphery of the body 12. The cutting segments are made of some suitable hard metal such as tungsten carbide.

The cutting segments 13 are located on the bed of a continuous recess 14 which extends around the periphery of the annular body. The recess 14 is actually divided into two distinct parts: a first part having a substantially horizontal bed 15 on which the cutting segments rest, and a second portion having a lower bed 16.

The cutting segments are held in the recess by means of a plurality of clamping blocks 17 each of which rests on the bed 16 and bears against one side of the cutting segments. The clamping blocks are held by means of bolts 18 which pass through the blocks and screw into the annular body.

The segments 13 are preferably tapered in cross-section, and the side of the recess (against which the segments bear) and the clamping blocks 17 are complementally undercut so that the segments are wedged between the side of the recess and the blocks.

In the manner described above the cutting segments can be spaced very closely to one another thus enabling a substantially continuous periphery of the segments to be obtained. Furthermore the cutting segments can by this arrangement be put under considerable compressive stress in two directions which will substantially reduce any tendency toward breakage under loads applied to the cutting edge.

We claim:

1. A rock-boring machine of the type comprising a rotatable headplate having a plurality of disc cutting units mounted on the front face of the headplate; each disc cutting unit comprising a base adapted to be secured to the front face of the headplate, a bearing shaft mounted on the base, an annular body journalled for rotation on the bearing shaft and having a continuous recess extending around its periphery, a plurality of cutting segments located in the recess to extend around the periphery of the body, and removable clamping means adapted to secure the cutting segments in the recess.

2. A rock-boring machine as claimed in claim 1 in which the removable clamping means comprises a plurality of clamping blocks adapted to be located around the periphery of the body and to be so secured to the body as to bear against one side of the cutting segments.

3. A rock-boring machine as claimed in claim 2 in which the cutting segments lie between a side of the recess and the clamping blocks, the segments being tapered in cross-section, and the said side and the blocks being complementally undercut so that the segments are wedged between the side of the recess and the clamping blocks.

4. A cutter for an earth boring system that has a rotary unit which bores into earth formations to form a hole therein, said rotary unit functioning to form circular kerfs in the formation being bored to fracture rock between a proximate pair of said kerfs in a manner that causes fragments of the formation to be separated from the formation being bored, comprising:

a cutting wheel mounted upon said rotary unit for rotary motion to roll along the kerfs being cut; replaceable cutting means substantially encircling said cutting wheel for contacting said formations and forming a kerf therein, said cutting means consisting of a plurality of cutting elements, each of which partially encircle said cutting wheel; and means for removably affixing said cutting means to said cutting wheel.

5. The cutter of claim 4 wherein said means for removably affixing said cutting means to said cutting wheel includes a plurality of locking elements adapted to contact said cutting means and retainer means for affixing said locking elements to said cutting wheel.

6. The cutter of claim 5 wherein said locking elements include tapered surfaces that overlap said cutting elements.

* * * * *